United States Patent [19]

Wernicke

[11] Patent Number: 5,063,144

[45] Date of Patent: Nov. 5, 1991

[54] PHOTOGRAPHIC COLOR DEVELOPER SOLUTION AND A PROCESS FOR THE DEVELOPMENT OF A COLOR PHOTOGRAPHIC MATERIAL

[75] Inventor: Ubbo Wernicke, Colonge, Fed. Rep. of Germany

[73] Assignee: Agfa Gevaert Aktiengesellschaft, Leverkusen, Fed. Rep. of Germany

[21] Appl. No.: 657,968

[22] Filed: Feb. 20, 1991

Related U.S. Application Data

[63] Continuation of Ser. No. 309,689, Feb. 10, 1989, abandoned.

[30] Foreign Application Priority Data

Feb. 24, 1988 [DE] Fed. Rep. of Germany ..... 3805699

[51] Int. Cl.[5] ..... G03C 5/30

[52] U.S. Cl. ..... 430/436; 430/434; 430/435; 430/464; 430/428; 430/484

[58] Field of Search ..... 430/399, 434, 436, 464, 430/484, 435, 478

[56] References Cited

U.S. PATENT DOCUMENTS

| | | | |
|---|---|---|---|
| 4,161,406 | 7/1979 | Bulloch | 430/468 |
| 4,756,997 | 7/1988 | Marcherano | 430/467 |
| 4,851,326 | 7/1989 | Ishikawa et al. | 430/464 |

FOREIGN PATENT DOCUMENTS 173203 3/1986 European Pat. Off. .

OTHER PUBLICATIONS

U.S. Application Ser. No. 07/290,351 filed on Dec. 27, 1988.

*Primary Examiner*—Hoa Van Le

*Attorney, Agent, or Firm*—Connolly & Hutz

[57] ABSTRACT

Development of a color photographic material in which the emulsion layers contain silver halide grains with a chloride content of at least 80 mol % can be completed within 40 seconds by using a substantially bromide free color photographic developer solution containing, in 1 liter of aqueous solution ready for use, from 4 to 15 g of the developer corresponding to the following formula

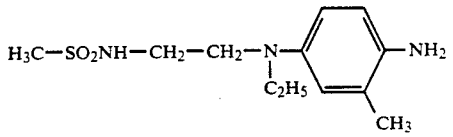

or a corresponding quantity of its salts, from 8 to 35 g of $PO_4^{3-}$ ions, at least 0.2 g of antioxidant, from 0.5 to 5.0 g of KCl and other conventional components and adjusted to a pH of from 10.4 to 12.9.

8 Claims, No Drawings

PHOTOGRAPHIC COLOR DEVELOPER SOLUTION AND A PROCESS FOR THE DEVELOPMENT OF A COLOR PHOTOGRAPHIC MATERIAL

This application is a continuation of application Ser. No. 07/309,689 filed Feb. 10, 1989, now abandoned.

Standardized development processes by which photographic recording materials of any origin can be processed according to their type are available for a major proportion of light sensitive silver halide recording materials, for example for the production of coloured reflection copies on colour negative paper, using a transparent colour negative composed of at least one blue s-sensitive silver halide emulsion layer containing a yellow coupler, at least one green sensitive silver halide emulsion layer containing a magenta coupler and at least one red sensitive silver halide emulsion layer containing a cyan coupler.

In the EP-2 process also known as Agfa Colour Process AP 92 which is employed world wide for processing colour negative paper, the imagewise exposed colour negative paper is subjected to a colour development, bleaching, fixing, washing and drying, bleaching and fixing being optionally replaced by bleach fixing and washing being optionally replaced by stabilization.

The time required for colour development is 210 seconds. Considerable efforts have been made to shorten this time, but no new process has hitherto become established in the art which could achieve the desired result with the colour negative paper conventionally used in the art, which consists mainly of silver bromide emulsion with only low proportions of chloride ( <20 mol % Cl).

The only process which has recently been introduced is one in which the development time is 45 seconds, but it requires a colour negative paper which consists predominantly of silver chloride emulsions ( >95 mol % Cl) and uses a different developer composition (RA-4 process). This process makes use of the known fact that chloride emulsions can be developed more rapidly than bromide emulsions.

It was an object of the present invention to provide a photographic process by which the development time could be further reduced for colour negative paPer having a high chloride content.

It has now been found that this problem is solved by using a developer which is characterised by a combination of certain concentrations of known developer components.

The present invention therefore relates to a colour photograpbic developer solution containing, in one liter of aqueous solution ready for use, a) from 4 to 15 g of the developer corresponding to the following formula

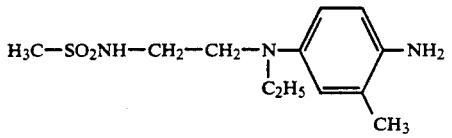

or a corresponding quantity of its salts (CD 3), b) from 0 to 2.0 g of developer corresponding to the following formula

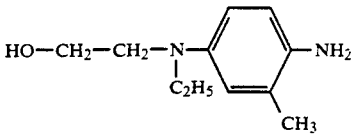

or a corresPonding quantity of its salts (CD 4), c) from 8 to 35 g of $PO_4^{3-}$ ions, in particular in the form of $K_3PO_4$ or $K_2HPO_4$, d) at least 0.2 g of antioxidant, e) from 0.5 to 5.0 g of KCl, f) from 0 to 0.5 g of KBr and other conventional components and adjusted to a pH of from 10.4 to 12.9. The developer is preferably bromide free.

Optical brighteners, polyalkylene glycols, surface active agents, water softeners and stabilizers, e.g. heterocyclic mercapto compounds or nitrobenzimidazole, and substances for adjusting the pH to the required value may be used as additional components. The developer solution may also contain up to 25 g of benzyl alcohol but it is preferable to use less than 5 g of benzyl alcohol and better still to use a developer solution free from benzyl alcohol.

Examples of suitable antioxidants are hydroxylamine, diethyl hydroxylamine and sulphites, preferably used in a quantity of up to 5 g.

The solution ready for use may be prepared from the individual components or from so called concentrates in which the individual components are dissolved at a substantially higher concentration. The concentrates are adjusted so that they can be used for the preparation of a so called replenisher, i.e. a solution which contains somewhat higher concentrations of the individual components than the solution ready for use and may on the one hand be made up into a solution ready for use by further dilution and the addition of a starter, preferably KCl, and on the other hand is continuously added to a developer solution in use to replace the chemicals which have been used up by development or carried out of the developer solution by overflow or wIth the developed material. Chloride ions need not normally be added except to the freshly prepared developer since chloride ions are released from the photographic material by the development process.

The developer composition according to the invention is so highly active that the development inhibiting action, e.g. of KCI, is easily overcome so that replenishment without overflow is possible.

The invention further relates to a process for the development of an exposed colour photographic material in which the light sensitive emulsion layers contain silver halide grains having a chloride content of at least 80 mol %, preferably at least 95 mol %, using the developer solution according to the invention, in particular to a development process in which development is completed within at the most 40 seconds, preferably not more than 20 seconds.

Within the given quantities of developers a) and b), the ratio by weight of a):b) is preferably greater than 4:1 for the sake of optimum light fastness. It is in fact preferable to use developer substance a) alone.

With the developer according to the invention, a colour photographic negative paper in which the light sensitive emulsion layers contain silver halide grains with a chloride content of at least 80 mol % can be developed within 15 seconds at temperatures of not more than 38° C. to produce images of excellent quality which are comparable to images obtained in 45 seconds on the same colour negative paper by the RA-4 process. In particular, there is no loss of light fastness of the colours.

If the development temperature is raised development times of up to 5 seconds can be achieved.

EXAMPLE 1

A commercial colour paper having a high chloride content (e.g. Kodak 2001 or Agfa colour type 9 with emulsions containing about 99.5 mol % $cl^{\ominus}$ and 0.5 mol % $Br^{\ominus}$, wad exposed imagewise, developed with the developer described below and bleached, fixed, washed and dried in conventional manner. The process was adjusted to the individual type with regard to minimum densities, $\gamma-1$ values, $\gamma-2$ values and maximum densities.

The aqueous developer contained the following substances per liter:

15 ml of benzyl alcohol
8.5 ml of diethylene glycol
1.0 g of diethyl hydroxylamine
11.0 g of CD-3
1.0 g of $K_2SO_3$
44 g of $K_3PO_4$
1.2 g of KCl and surface active agents, optical brighteners, stabilizers and water softeners in the usual quantities and was adjusted to pH 11.6.

Development time: 15 seconds/38° C.

COMPARISON EXAMPLE (RA-4 PROCESS)

Example 1 is repeated with a developer of the following composition:

11 ml of triethanolamine
6 ml of an 85% aqueous solution of diethyl hydroxylamine
0.3 g of $K_2SO_3$
5 g of CD-3
25 g of $K_2CO_3$
2.3 g of KCl and surface active agents, optical brighteners, stabilizers and water softeners in the usual quantities. The developer is adjusted to pH 10 1 with KOH.

Development time: 45 seconds/35° C.

EXAMPLE 2

Example 1 is repeated but without the use of benzyl alcohol or diethylene glycol.

Development time: 15 seconds/38° C.

The following maximum densities were obtained:

| | Example 1 | Comparison Example | Example 2 |
|---|---|---|---|
| Yellow | 242 | 243 | 240 |
| Magenta | 273 | 247 | 268 |
| Cyan | 284 | 246 | 271 |

I claim:

1. Color photographic developer solution for development in a negative process containing, in 1 liter of solution ready for use consisting essentially of a) from 4 to 15 g of the developer corresponding to the following formula

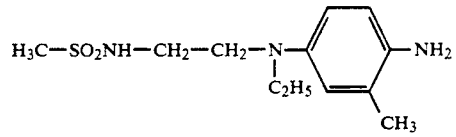

or a corresponding quantity of salts thereof (CD 3), b) from 0 to 2.0 g of developer corresponding to the following formula

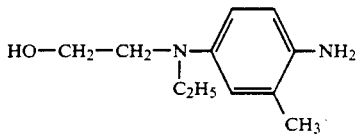

or a corresponding quantity of salts thereof (CD 4), c) from 8 to 35 g of $PO_4^{3-}$ ions, d) at least 0.2 g of antioxidant, e) from 0.5 to 5.0 g of KCl, f) from 0 to 0.5 g of KBr, and one or more conventional components selected from the group consisting of optical brightners, polyalkylene glycols, surface active agents, water softeners, stabilizers, benzyl alcohol and substances for adjusting the pH to from 10.4 to 12.9.

2. Colour photographic developer solution according to claim 1 in which the ratio by weight of a):b) is greater than 4:1.

3. Colour photographic developer solution according to claim 1, characterised in that it contains no developer substance b).

4. Colour photographic developer solution according to claim 1, characterised in that it is free from benzyl alcohol.

5. Process for the development of an exposed colour photographic material in which the light sensitive emulsion layers contain silver halide grains with a chloride content of at least 80 mol %, characterised in that a developer solution according to claim 1 is used.

6. Process for development according to claim 5, characterised in that development is completed in at most 40 seconds.

7. Process for development according to claim 5, characterised in that development is completed in at most 20 seconds.

8. Process for development according to claim 5, characterised in that the silver halide grains contain at least 95 mol % of chloride.

* * * * *